US005460109A

United States Patent [19]

Adamski, Jr. et al.

[11] Patent Number: 5,460,109

[45] Date of Patent: Oct. 24, 1995

[54] METHOD AND APPARATUS FOR AUTOMATICALLY ATTACHING A COLLARETTE, DISPLAY, AND LABEL TO A GARMENT BODY

[75] Inventors: Maximilian Adamski, Jr., Palatine; Kenneth C. Milner, Lake Zurich, both of Ill.; Edward R. LaVelle, Staley; John C. McEwen, Mocksville, both of N.C.

[73] Assignees: Union Special Corporation, Huntley, Ill.; Sara Lee Corporation, Winston-Salem, N.C.

[21] Appl. No.: 283,737

[22] Filed: Aug. 1, 1994

Related U.S. Application Data

[63] Continuation of Ser. No. 711,315, Jun. 6, 1991, Pat. No. 5,375,545.

[51] Int. Cl.[6] ..... D05B 35/06; D05B 19/00

[52] U.S. Cl. ..... 112/475.09; 112/113; 112/470.02

[58] Field of Search ..... 112/121.11, 265.1, 112/262.1, 152, 130, 121.27, 147, 113

[56] References Cited

U.S. PATENT DOCUMENTS

| | | | |
|---|---|---|---|
| 3,664,284 | 5/1972 | Hester | 112/152 |
| 3,750,603 | 8/1973 | Martin | 112/121.11 X |
| 4,432,294 | 2/1984 | Price et al. . | |
| 5,040,472 | 8/1991 | Schips | 112/113 X |

FOREIGN PATENT DOCUMENTS

| | | |
|---|---|---|
| 2594013 | 8/1987 | France . |
| 0277487 | 11/1990 | Japan . |

*Primary Examiner*—Peter Nerbun
*Attorney, Agent, or Firm*—Morgan & Finnegan

[57] ABSTRACT

An improved method and apparatus for attaching a collarette, display, and label incorporating the use of a sewing machine having a sewing head a collarette feeder, a display feeder, a label feeder synchronized with the sewing head, a garment detector, a seam detector, a stitch counter, and a controller to control each device and perform necessary calculations is disclosed.

14 Claims, 9 Drawing Sheets

METHOD AND APPARATUS FOR AUTOMATICALLY ATTACHING A COLLARETTE, DISPLAY, AND LABEL TO A GARMENT BODY

CROSS REFERENCE TO RELATED APPLICATION

This application is a continuation of application Ser. No. 07/711,315 filed on Jun. 6, 1991, now U.S. Pat. No. 5,375,545.

BACKGROUND OF THE INVENTION

1. Field of the Invention

The present invention relates to an improved method and apparatus for automatically attaching a collarette, display, and label to a garment body by synchronized sewing material feeding.

2. Description of the Prior Art

Garments such as shirts or blouses are typically. manufactured using manual labor. Garment pieces are cut out of stock material, trimmed to proper dimensions, and then sewn together on a sewing machine by a sewing machine operator.

Often in garment manufacturing, a piece of material, known in the art as a "collarette" is folded and sewn around the garment neck to form a continuous collar. The conventional method of sewing a collarette to a garment neck is performed by a sewing machine operator in the following manner. First, the collarette is cut to a size slightly shorter than the garment neck edge where the collarette is to be sewn. Then, the operator positions the collarette on top of the garment body, places the material under a sewing machine and starts sewing. While sewing, the operator must continually maintain the alignment of the collarette and garment body to obtain an evenly manufactured finished product. Additionally, the operator must pull and stretch the collarette during the sewing operation. Stretching the collarette in such a manner will cause the completed garment and collarette to lie flat and have no wrinkles or gathers around the neck when worn.

The operator may also be required to attach a label (e.g. a manufacturer's identifier having the manufacturer's name and product information) to the garment with the same stitch being used to attach the collarette to the garment. To perform this operation, the operator must carefully position and hold the label in the desired location while sewing.

Additionally, the operator may be required to sew a small strip of material, known in the art as a "display", to the inside of the garment neck to flatten and cover the seam joining the collarette and label to the garment body (the "joining seam"). The display is used to cover the area inside the garment where the joining seam would be partially visible after the garment is packaged for sale, i.e., on the inside back portion of the garment neck. To sew a display the operator must carefully position the display on top of the collarette and garment body and hold the display in position while sewing.

Further complications to the above-described conventional sewing operation are encountered when the joining seam is to be hidden from view from the outside of the garment (i.e. the side of the garment away from the body of the wearer). To hide the joining seam, an operator must layer the collarette display, and label on top of the garment body and use an "overedge stitch" to join the pieces together. The resulting "overedge seam" is then hidden from the outside of the finished garment. To sew a collarette, label, and display to a garment body with an overedge stitch an operator must first manually arrange and layer the materials one on top of the other as follows: garment body, collarette, display, and label. The operator then passes the layered materials through the sewing machine, maintaining them in constant alignment while stretching the collarette as described above. If desired, a second sewing operation is then performed to attach the loose edge of the display to garment body with a top stitch to assure that the display covers the overedge seam and a portion of the label.

The manual process of sewing a collarette, display, and label to a garment body is difficult and tedious. The quality of the finished product is often variable and is largely dependent on the experience and skill of the sewing machine operator. Moreover, the conventional process is time consuming due to the need to precisely arrange and sew the materials together.

One solution to the above-identified problems is disclosed in U.S. Pat. No. 5,315,946 issued on May 31, 1994 for A METHOD AND APPARATUS FOR AUTOMATICALLY ATTACHING A COLLARETTE, DISPLAY, AND LABEL TO A GARMENT BODY, commonly assigned to Sara Lee Corporation, the disclosure of which is hereby incorporated by reference herein. U.S. Pat. No. 5,315,946 discloses a method and apparatus for automatically attaching a collarette, display, and label to a garment body using, inter alia, a collarette feed means, display feed means, label feed means and a controller means. As disclosed therein, the controller means counts the total number of stitches since the start of a sewing operation. When the total stitch count equals certain predetermined stitch counts, the controller means commands the display feed means and label feed means to feed their respective material under a sewing head.

Variations in garment body dimensions often occur within a garment body size. For example, a garment neck edge can vary in length from garment to garment within a garment size by as much as plus or minus one inch (+/−1") resulting in an overall edge length variation of four inches (4"). The use of predetermined total stitch count values based on the start of a sewing operation to command display and label feeding cannot account for the above described length variations that exist from garment to garment within a garment size. As a result, inconsistent placement of display and label can occur.

Additionally, using a motor to drive the label feed means independently from, i.e. not synchronized with, the motor driving the sewing head can cause the label to be misaligned when placed under the sewing head and cause the label to skew.

Further, feeding the collarette and display material on top of the garment body can obstruct the field of view of the sewing head making it difficult for an operator to assure the sewing operation is being performed properly.

Further, the layering from bottom to top of garment body, collarette, display, and label can complicate the automation of the subsequent operation of sewing the loose edge of the display over the overedge seam with a top stitch. Specifically, automating the second sewing operating when the display and collarette is placed on top of the garment body would require an apparatus to be able to fold the display underneath the garment body and collarette and to sew the display "blind" through the garment body and collarette. Such an apparatus would be difficult to construct and operate and would prevent the operator from being able to visually check whether the display has been folded and sewn properly in the second sewing operation until after the operation is complete.

It is therefore an object of the present invention to provide a new and improved method and apparatus for automatically attaching a collarette and other materials to a garment body.

Another object of the present invention is to provide a new and improved method and apparatus capable of attaching a collarette, display, and label to a garment body in an efficient and precise manner without the need of manual assistance to feed and maintain alignment of the materials during the sewing operation.

It is still a further object of the present invention to provide a new and improved method and apparatus capable of attaching a collarette, display, and label to a garment body such that the resulting product is of a consistently high quality, but manufactured using less time and manpower.

It is still a further object of the present invention to provide a new and improved method and apparatus for accurately placing a display and label on a garment body.

It is still a further object of the present invention to provide a new and improved method and apparatus for preventing a label from becoming skewed while being sewn to a garment body.

It is still another object of the present invention to provide a new and improved method and apparatus for feeding a collarette, display, and label to a sewing head without obstructing the field of view of the sewing head.

It is still a further object of the present invention to provide a new and improved method and apparatus for simplifying a second automated sewing operation to sew the loose edge of the display over an overedge seam with a top stitch.

SUMMARY OF THE INVENTION

The above-described and other objects of the invention are met by providing an apparatus for attaching a collarette, display, and label to a garment body preferrably incorporating a sewing machine having a sewing head, a collarette feed means, a display feed means, a label feed means synchronized with the sewing head, a seam deflector means, a seam detector means, a label deflector means, a garment detector means, a stitch count means, and a controller means to control each device and perform necessary calculations.

In a preferred embodiment, an operator places a garment body on the sewing machine and presses a foot switch to activate same. If a garment is detected by the garment detector means, the sewing machine is activated and sewing starts. As the garment is being fed through the sewing machine, collarette material is stretched and automatically fed and sewn under the garment body by the collarette feed means. Additionally, the controller means in combination with the stitch count means counts the total number of stitches (N) sewn.

When a first total stitch count ($N_1$) from the start of the sewing operation equals a predetermined stitch count for seam detection ($N_1=n_s$), the controller means commands the seam deflector means to lower into the sewing area and activates the seam detector means. When the garment body shoulder seam advances towards the sewing area, the seam deflector presses the shoulder seam down so as to help the seam detector means detect the presence of the shoulder seam. The seam detector is only activated when the seam deflector is in position so that wrinkles and folds, characteristic of soft cloth, do not create false seam detection signals. When the seam detector means detects the presence of the shoulder seam, the controller means commands the display feed means within a predetermined number of stitch counts to move into the sewing area and begin feeding the display material under the sewing head. By using the detection of each garment body shoulder seam to command the commencement of display feeding, accurate placement of display material relative to each garment body is achieved.

The controller means then determines the number of stitches to count before inserting a label ($n_{sl}$). By using the first total stitch count ($N_1$) from the start of the sewing operation to shoulder seam detection for each garment body being sewn and multiplying same by a ratio factor (R) the method and apparatus of the present invention can accurately determine the center label position for each garment body being sewn. Referring to FIG. 2, the preferred ratio factor (R) is based on garment body size and is calculated by dividing half the distance from the shoulder seam to the trailing neck garment edge ($d_e$) by the distance from the leading neck garment edge to the shoulder seam ($d_s$)

$$\left( R = \frac{0.5 \times d_e}{d_s} \right)$$

The controller means then determines the number of stitches to the center of the label ($n_{cl}$) by multiplying the first total stitch count ($N_1$) from the start of the sewing operation to seam detection by the preferred ratio factor ($n_{cl}=N_1 \times R$). The controller means then subtracts one-half the number of stitches required to sew the width of the label ($n_{wl}$) to determine the number of stitches to count before inserting the label ($n_{sl}=n_{cl}-0.5 \times n_{wl}$).

After seam detection, the controller means maintains a second total stitch count ($N_2$) from seam detection and when the second total stitch count equals the number of stitches to count before inserting the label ($N_2=h_{sl}$) , the controller means commands the label feed means to automatically feed a label to the sewing area. The label feed means is synchronized with the sewing head causing the label to be fed evenly under the sewing head thereby preventing the label from skewing while being sewn to the garment body.

When the garment detector means detects the end of the garment body the controller means, after a predetermined number of stitches, commands the display feed means to move away from the sewing area and terminate the sewing of the display material. Finally, when the garment detector means fails to detect the presence of another garment, the sewing machine stops sewing after a predetermined number of stitches. The last predetermined stitch count controls the spacing of the garments being sewn through the apparatus of the present invention.

By using the detection of a garment body shoulder seam as a reference point for display and label feeding and maintaining a total stitch count during the sewing operation, the present invention is able to accurately determine the commencement and termination of the mechanical feeding of a display and label for the particular dimensions of each garment body being sewn. As a result, the present invention is able to achieve a consistently even manufactured product in less time using less manpower.

Additionally, by synchronizing label feeding with the overall sewing operation the present invention is able to prevent label skewing.

Further, by feeding the collarette and display material underneath the garment body during the sewing operation the present invention allows an operator to have a clear field of view of the sewing head during a sewing operation and simplifies the automation of the second sewing operation by enabling the display material to be folded from underneath to on top of the garment body to allow an operator a clear field of view of a second sewing operation.

BRIEF DESCRIPTION OF THE DRAWINGS

The invention will be described in greater detail below by use of reference to the accompanying drawings, wherein.

DETAILED DESCRIPTION OF THE PREFERRED EMBODIMENTS

Figure 1:
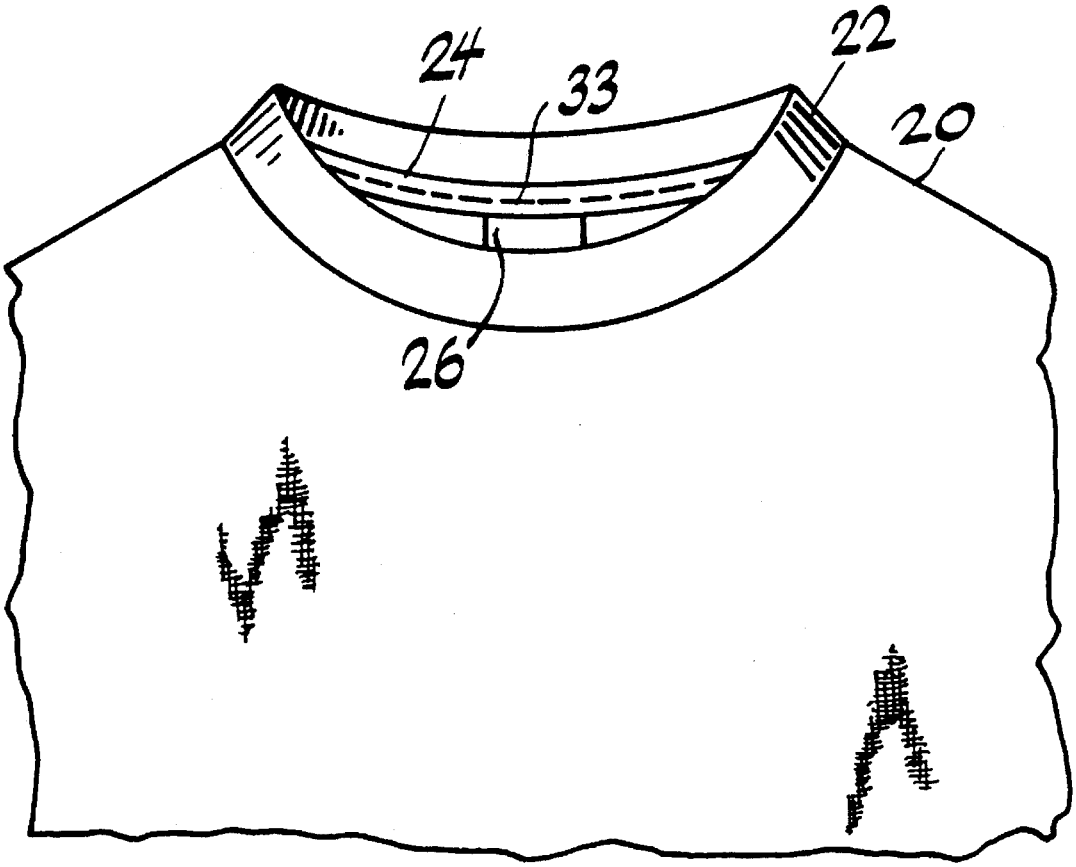
FIG. 1 is of a completed garment having a collarette, display, and label.

Referring to the drawings, FIG. 1 is an illustration at the components of a completed garment having a collarette display 24, and label 26 fashioned from known materials used for shirts, blouses, or the like. The dimensions of the various pieces are based on the desired size of the finished product. For example, in an average T-shirt, the width of collarette 22 is typically in the range of 1 3/16" to 1 7/16" and the width of display 24 is typically 7/16" to ½" wide. As will become readily apparent to those skilled in the art, the widths of the collarette and display can be easily varied.

Label 26, which provides the purchaser or wearer with information concerning the garment (e.g., size, manufacturer, washing instructions), may be made from various known materials such as nylon, cloth, or the like. The size of label 26 is usually dependent on the amount and the size of the writing present.

As shown in FIG. 1, display 24 and label 26 are affixed in a position such that display 24 covers the overedge seam (not shown) which would be visible along the inside the garment neck when the garment is placed on its back. Also shown is top stitch 33 used in a second sewing operation to sew the loose end of the display over the overedge seam.

Figure 2:
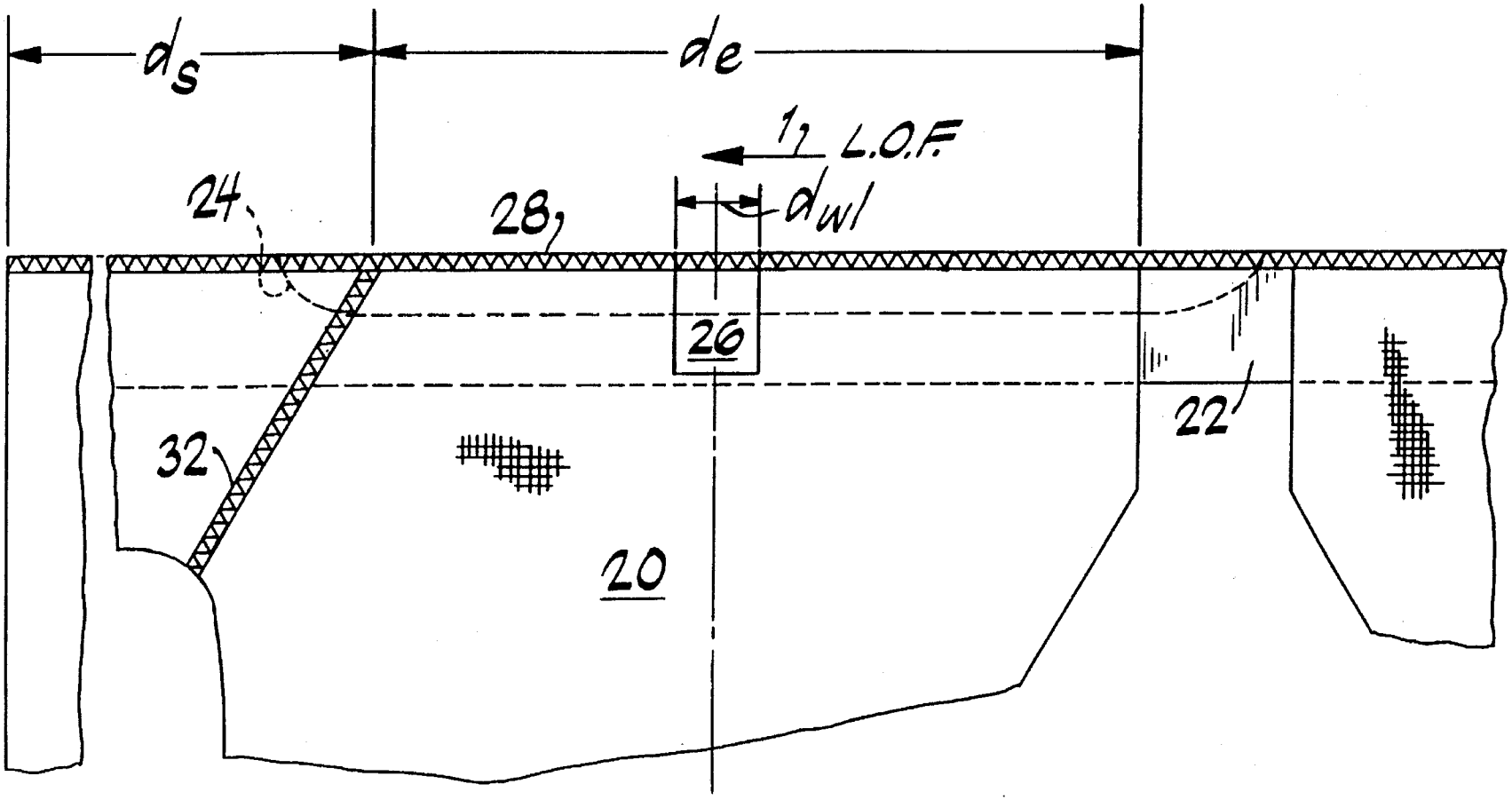
FIG. 2 is a planar view of the layered arrangement of garment body, collarette, display and label as they are sewn together using an overedge stitch.

FIG. 2 is a planar view illustration of the layering of display 24, collarette 22, garment body 20, and label 26 as fed through the apparatus of the present invention. The layering allows the display, collarette, garment body, and label to be sewn together with a single overedge stitch. The overedge stitch, known in the art as a 504 SSa-1 stitch, forms an overedge seam 28. To assure proper placement of display 24, the display is preferrably sewn so as to overlap shoulder seam 32 by approximately ¾" of an inch. As will become readily apparent to those skilled in the art, the overlap distance can be varied as desired. Line of feed ("L.O.F.") arrow I indicates the direction the display, collarette, garment body, and label are fed through the sewing apparatus of the present invention.

Figure 3:
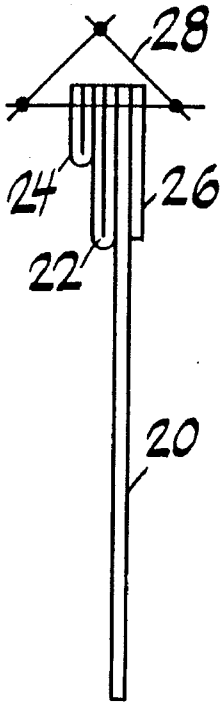
FIG. 3 is a side view of the layered arrangement of FIG. 2.

FIG. 3 is a side view illustration of the layering of FIG. 2 as fed through the sewing apparatus of the present invention. The display 24 and collarette 22 are placed under garment body 20 and label 26 is placed on top of garment body 20. The layering of these materials as shown in FIG. 3 has several advantages. First, positioning the collarette and display material as illustrated allows the materials to be fed under the garment body. Accordingly, an operator is afforded a clear unobstructed view of the sewing head during a sewing operation. Additionally, the layering of the display and collarette underneath the garment body simplifies the automation of the second sewing operation wherein the loose end of the display is sewn over the overedge seam with a top stitch. Specifically, the display material can be folded from under the garment body to a top thereof to allow a second sewing operation to be performed in clear view of the operator.

Figure 8B:
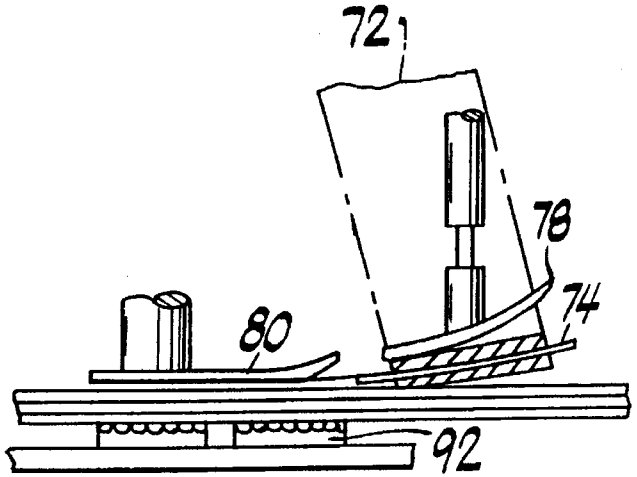
FIGS. 8A and 8B are close-up side views of the seam and label deflectors respectively.
Figure 8A:
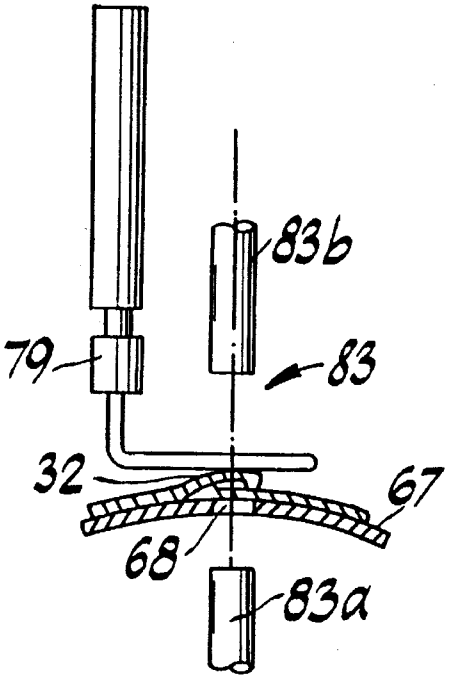
Figure 4:
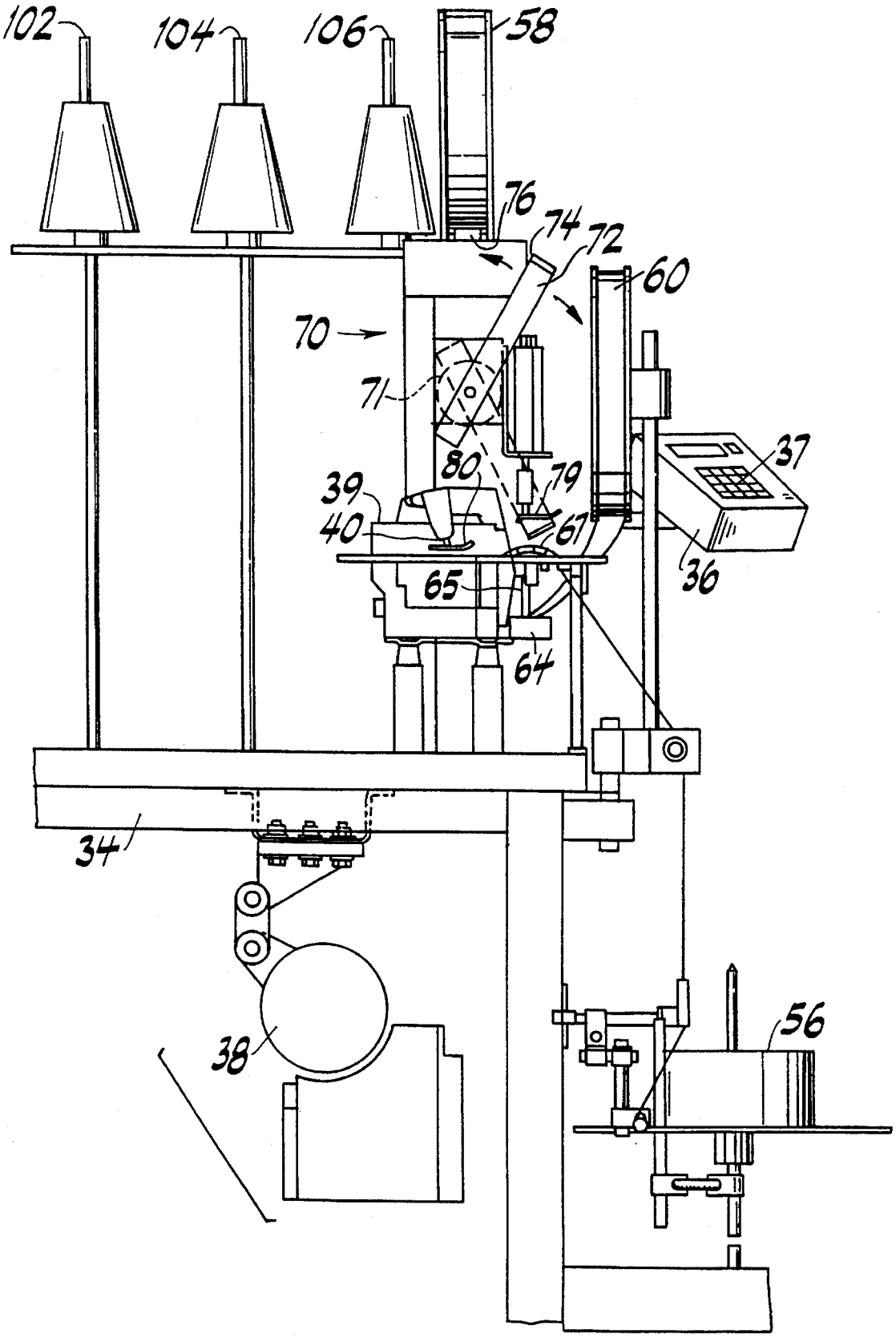
FIG. 4 is a left side view of an embodiment according to the present invention.
Figure 5:
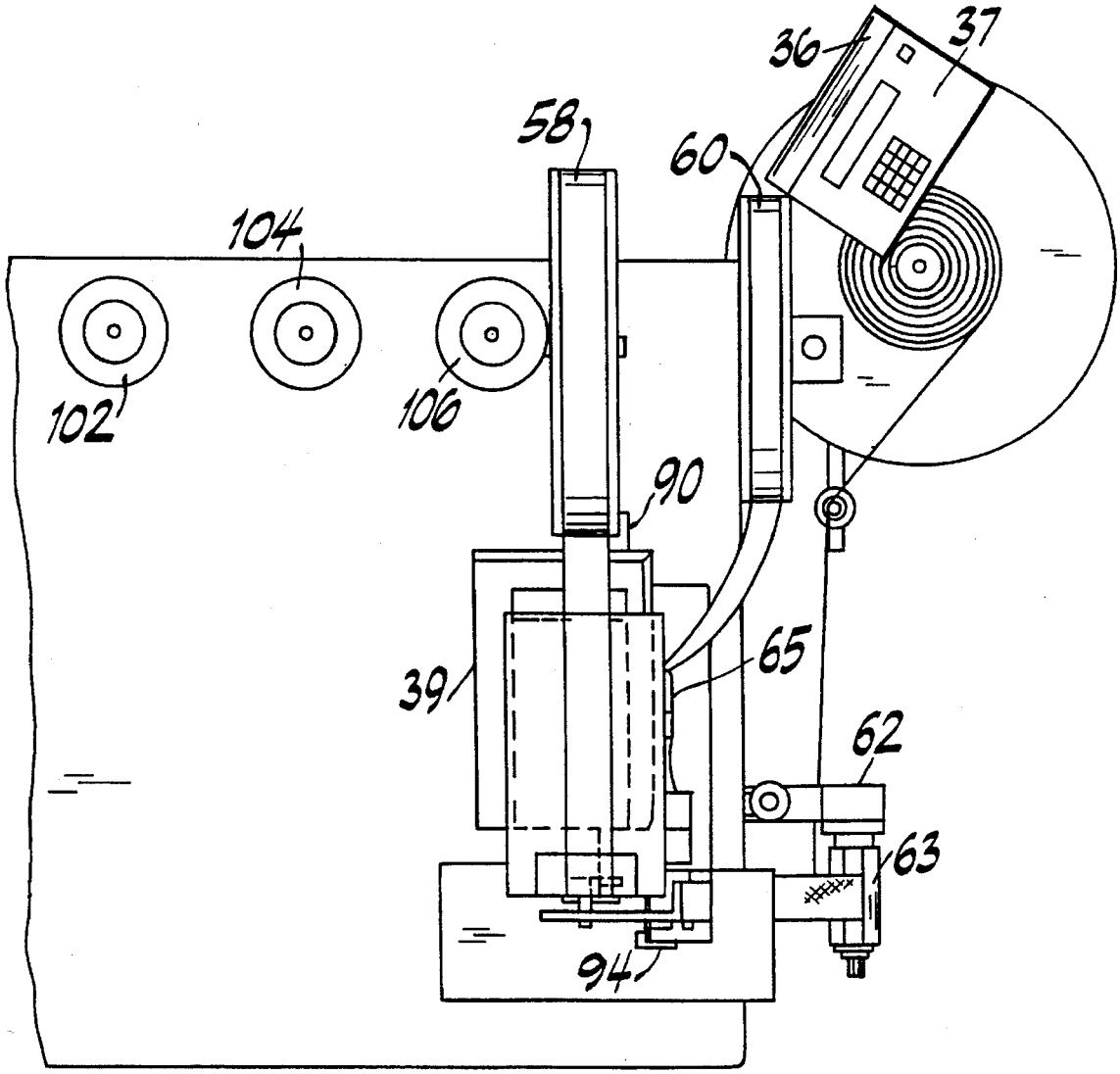
FIG. 5 is a top view of the embodiment of FIG. 4.
Figure 6:
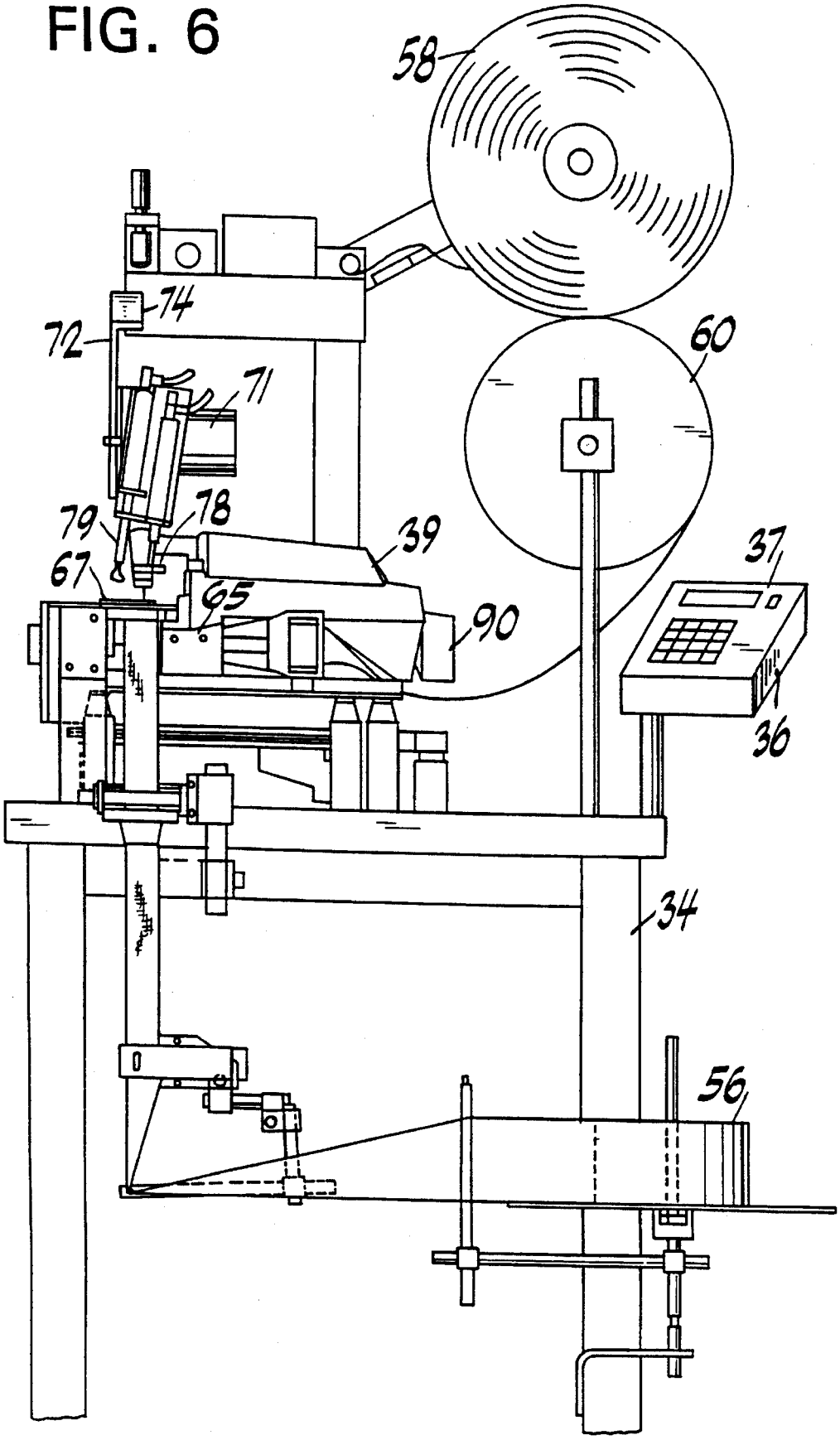
FIG. 6 is a front view of the embodiment of FIG. 4.
Figure 7:
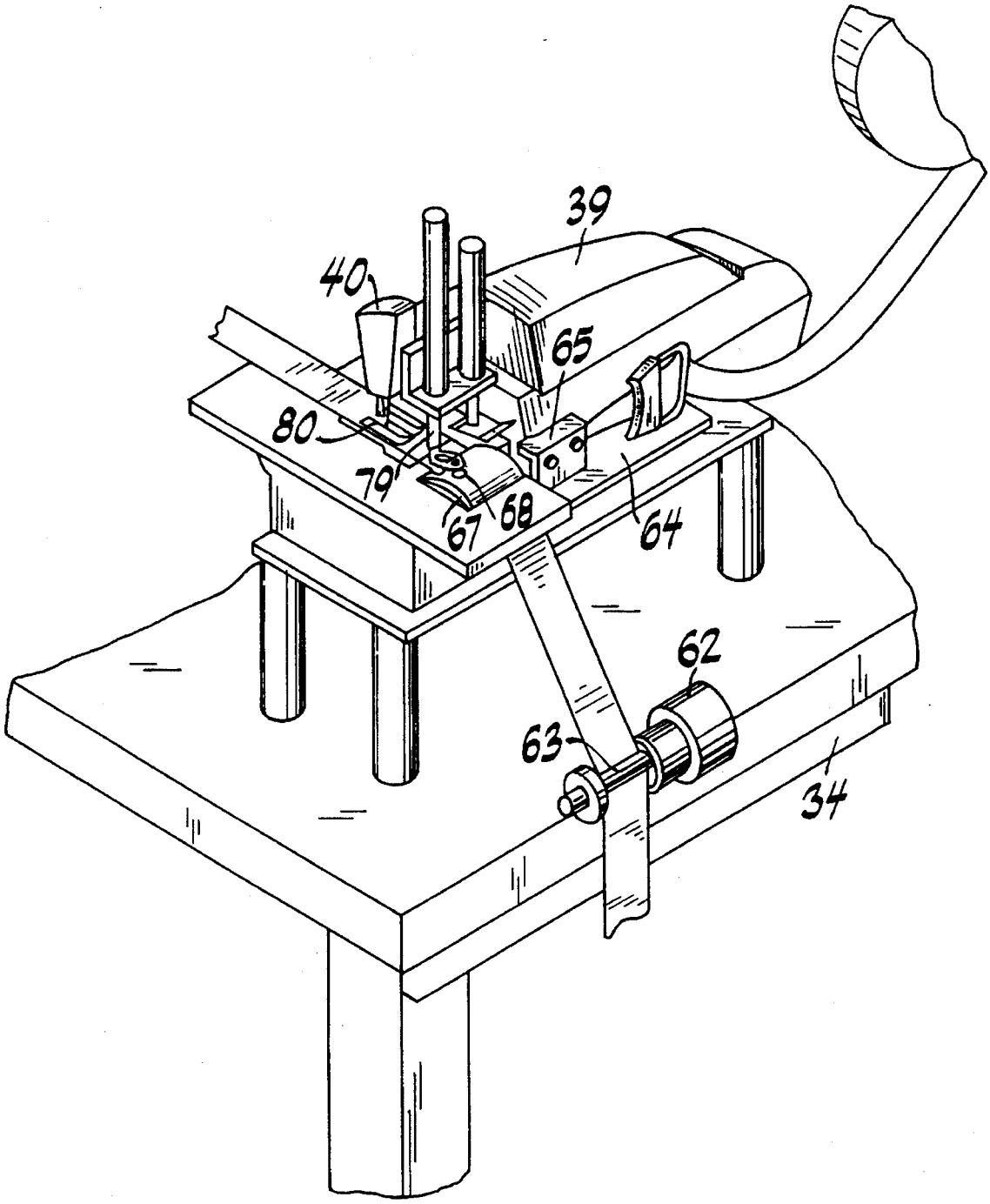
FIG. 7 is a three dimensional view of the embodiment of FIGS. 4, 5 and 6.

A preferred embodiment of the present invention is illustrated in the side, top, and front views of FIGS. 4, 5, and 6 respectively as well as the three dimensional view of FIG. 7 and the close-up side views of FIGS. 8A and 8B.

Frame 34 is used to support the various elements of the present invention. Controller 36 having a control panel 37 is attached to the front of frame 34 as shown. In the preferred embodiment, a Union Special C.P.U. Design is used as controller 36. Control panel 37 is used to allow the operator to input to the controller certain predetermined garment parameters such as size and style (e.g. distance to shoulder seam label width overlap distance and the like). Motor 38 is used to drive sewing machine 39 having a sewing head 40. In a preferred embodiment, a 39500 series sewing machine, manufactured by Union Special Corporation of Chicago, Ill., is used. Stitch counter 90 is used to count each revolution, which represents one stitch, of sewing head 40 and signals same to controller 36 which maintains a total stitch count for each sewing operation.

Rolls 56, 58 and 60 are used to provide a continuous supply of collarette 22, label 26, and display material 24 respectively. As will become readily apparent to those skilled in the art, the supply of these materials may be from flat continuous strips of folded material, commonly called festooning. The size and dimension of supply rolls 56, 58 and 60 are dependent on the materials used. Additionally, thread supply spools 102, 104 and 106 are used to supply thread to sewing head 40 in a known manner.

Collarette feed motor 62 drives collarette feed rollers 63 which are used to maintain the collarette in tension between the rollers 63 and the sewing head 40. The tension created effectively stretches the collarette material as it is being sewn to the garment body so that the completed garment and collarette will lie flat and have no wrinkles or gathers around the neck when worn. As shown, the collarette material is fed underneath the garment body. Accordingly, when an operator sews the collarette to the garment body, the operator is afforded a clear unobstructed view of the sewing head 40.

Display feeder 65 is used to fold the display material and to guide same into the sewing area so as feed the display material 24 underneath collarette material 22 and under presser foot 80 and sewing head 40. The resulting adhesion between the collarette 22 and the display 24 while under sewing head 40 causes the display material to unroll from display supply roll 60 and feed under the sewing head 40. Pneumatic display feed inserter 64 is used to move display feeder 65 into and out of the sewing area on command from the controller 36. As with the feeding of the collarette material, the display material is fed under the garment body allowing an operator to have an unobstructed view of the sewing head 40 during the sewing operation. Plate 67 is used to help guide the collarette material over the display feeder 65 and under presser foot 80.

Label feeder 70 is used to cut labels from supply roll 58 and feed same to sewing head 40. The label feeder comprises a stepper motor 71 to drive label arm 72, a pneumatic gripper 74 for gripping a label 26, and a hot wire knife 76 for cutting labels from the label supply roll 58. On command from controller 36, the label arm 72 and gripper 74 grab a label 26 from the hot wire knife 76 and delivers same under presser foot 80 to sewing head 40. The cycle of movement of the output shaft of the label stepper motor 71 is synchronized with the cycle of movement of the motor driving sewing head 40 so as to synchronize the label feeding operation with the overall sewing operation. Synchronizing the cycle of movement of the output shaft of the label feeder stepper motor with the cycle of movement of the motor driving the sewing head allows the gripper 74 to hold on to the label as it is being sewn to the garment body under sewing head 40 effectively preventing the label from skewing during the sewing operation.

As shown in detail in FIG. 8A, pneumatic label guide 78 is used to help guide the label under the presser foot 80 and sewing head 40. On command from the controller 36, the label guide 78 lowers into the sewing area to be in alignment with the label feeder to help guide each label under presser foot 80 and sewing head 40. Also shown are feeddogs 92

A garment detector 82 comprising a light emitting diode ("LED") and a photodetector, is used to detect the presence of a garment body in the sewing area. Specifically, light from the LED is directed downward to the sewing area and reflected back to the photodetector by reflective patch 94. When a garment is place in a sewing area and top of the reflecting patch 94, the light being reflected from the LED is blocked and therefore not detected by the photodetector causing the garment detector to signal to the control means a "garment present" signal. As will become readily apparent to those skilled in the art, a through-beam photodetector similar to the seam detector described below can also be used as a garment dector.

A through-beam seam detector 83, comprising LED 83*a* and photodetector 83*b*, is used to detect the garment body shoulder seam during a sewing operation. In a preferred embodiment, the LED 83*a* is placed under plate 67 and emits light vertically through a hole 68 in plate 67. The light is detected by photodetector 83b placed atop thereof. The LED must emit sufficient light so as to allow the photodetector to detect same when a garment body is placed on top of the LED. Accordingly, when a shoulder seam passes over the LED, the light being detected by the photodetector will be blocked by the seam causing the seam detector to signal a "seam present" signal to the controller. Referring to FIG. 8B, a pneumatic seam deflector 79 is used to deflect a garment body shoulder seam to create a wider sensing window so as to help the seam detector detect same. Specifically, the seam deflector will, on command from the controller 36, lower into the sewing area and press the shoulder seam 32 down to effectively block the light emitted from LED 83*a*. Preferably, seam detector 83 is activated by the controller 36 only when the seam deflector is lowered into the sewing area so as to avoid false seam detection signals caused by wrinkles and folds characteristic in garments made of soft cloth.

In the preferred embodiment, all motors, pneumatic devices, and sensors are digital devices. Nevertheless, as will become readily apparent to those skilled in the art, analog devices can be used for some or all of the devices.

Once a device is configured as described above, the sewing method of the present invention can be performed as described below.

To begin, an operator feeds the collarette and display material through their respective feed mechanisms to effectively prime the apparatus for commencement of a sewing operation.

Referring to FIG. 2, the operator then measures in inches the approximate distance ($d_s$) from the leading garment body edge to the shoulder seam ($d_s$) for the particular garment size, e.g. small, medium, large, extra large and the like. The operator then converts the distance value to stitch counts ($n_s$) by equation: $n_s=d_s \times s$, where s is the number of stitches per inch the sewing head 40 performs. In a preferred embodiment, s has the value of approximately 12 stitches per inch (s=12). The resulting value ($n_s$) represents the number of stitches to count before a seam can be detected. Additionally, the operator measures the width of the label ($d_{wl}$) and using the above described equation converts the width to stitch counts ($n_{wl}$).

To determine the preferred ratio factor (R) for a particular garment size, the operator measures the distance from the shoulder seam to the trailing garment body edge ($d_e$). The ratio factor (R) is then determined by the following equation:

$$R = \frac{0.5 \times d_e}{d_s}$$

It has been found that for most T-shirts, R has a preferred value of 32% (R=0.32).

Figure 9A:
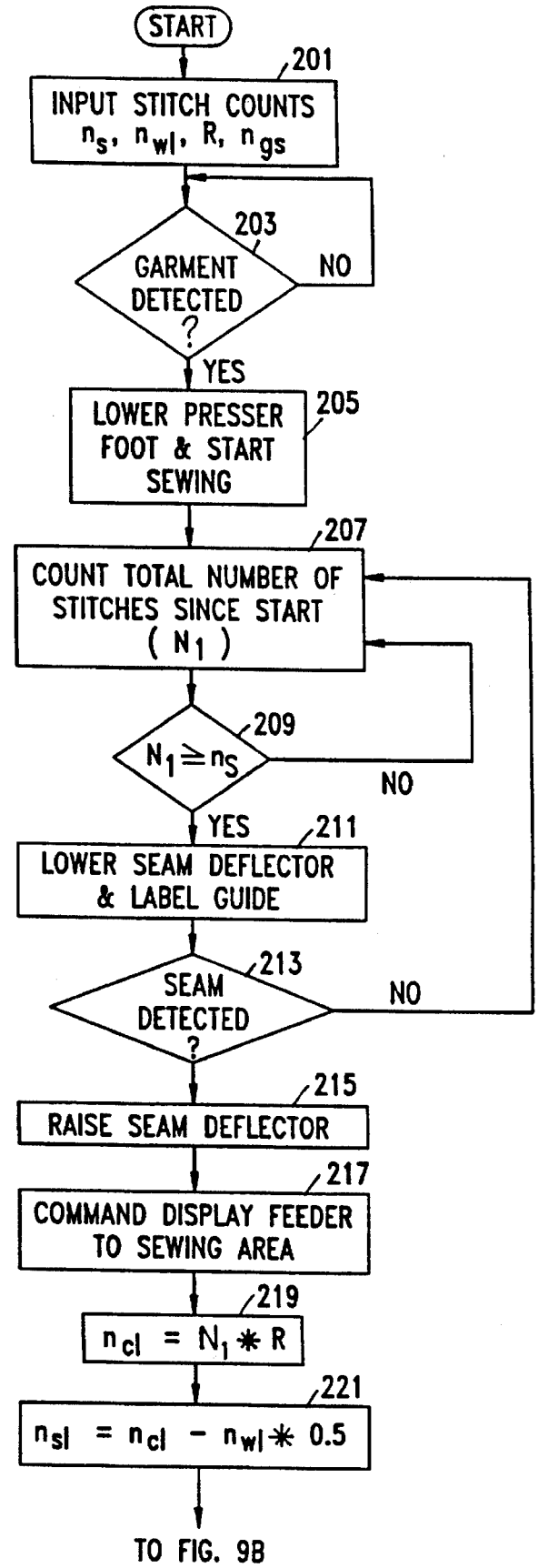
FIGS. 9A and 9B are a flow chart of the operation of the present invention.
Figure 9B:
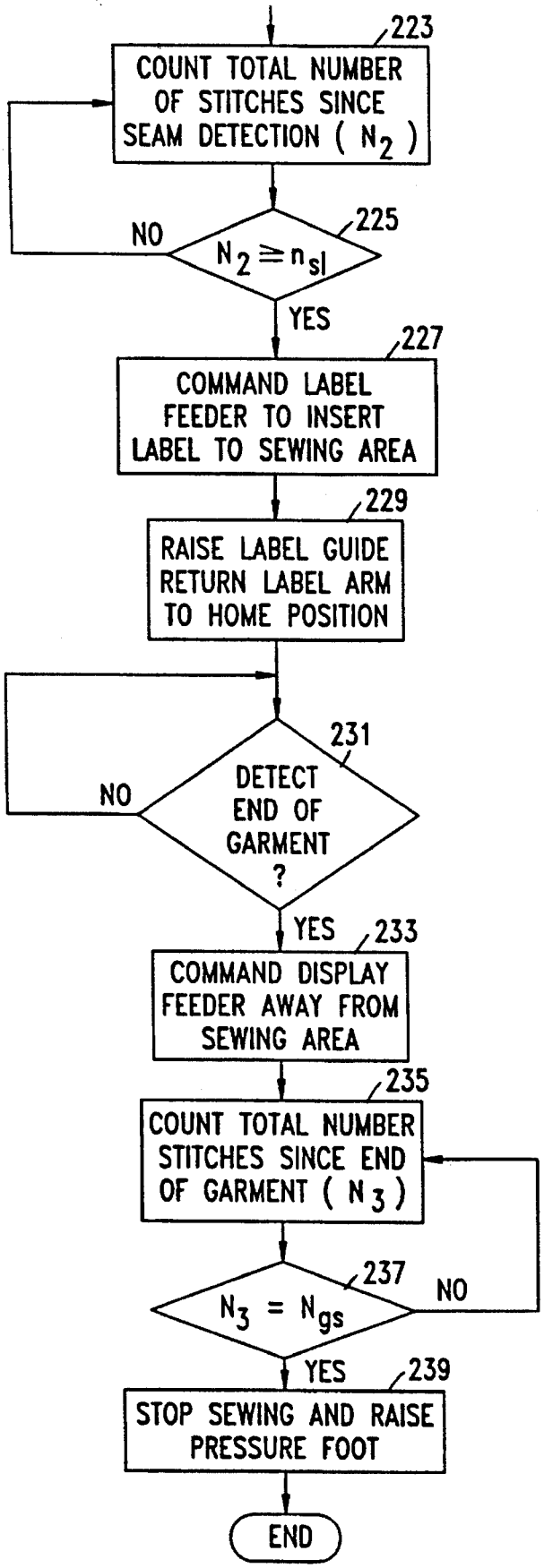

The operator then activates the controller via the control panel to start a sewing operation. Referring to the flow chart of FIGS. 9A and 9B, the controller executes the series of steps illustrated therein and described as follows. The controller begins at step 201 where the operator inputs via control panel 37 the predetermined values the distance in stitches counts from the leading garment body edge to the shoulder seam ($n_s$), the label width in stitch counts ($n_{wl}$), the ratio factor (R), and the garment spacing in stitch counts ($n_{gs}$).

The controller then advances to step 203 where it waits for a garment to be detected, i.e., loaded on to the sewing machine 39. The operator then manually loads the garment body 20 until its leading edge is under presser foot 80. It will be apparent to those skilled in the art that the loading of the garment body may be accomplished by manual or automated mechanisms. As described above, when the garment body 20 and collarette 22 are maneuvered under presser foot 80, material present sensor 82 signals to the controller 36 that a garment is present. The controller then advances to step 205 where the controller directs sewing head 40 to lower the presser foot 80 and start sewing the collarette 22 to the garment body 20. In preferred embodiments, sewing operation does not actually begin until the operator presses on a foot switch (not shown). The foot switch acts as a separate safety feature and control mechanism. Alternatively, a highly trained operator could have the option of using an "auto start" mode where, once the garment is detected and after an adjustable time delay, sewing would start automatically without use of the foot switch.

Once sewing starts, both the garment body and collarette are urged under presser foot 80 by forces generated by feed dogs 92 under the garment body material. The frictional interference between the collarette material 22 and the garment body 20 also assists in maintaining the position of the collarette under presser foot 80. Additionally, as described above, collarette feed rollers 63 maintain the collarette material in tension between the rollers 63 and the sewing head 40.

The controller then advances to step 207 where a first total stitch count ($N_1$) from the start of a sewing operation is determined by controller 36 by adding each stitch count signal from stitch counter 90. Next, a determination is made at step 209 as to whether the first total stitch count ($N_1$) is greater than or equal to the predetermined number of stitches to count before detecting the shoulder seam ($N \geqq n_s$). If false, the controller returns to step 207 to continue counting stitches. If true, the controller advances to step 211 where it activates the seam detector 83 and commands the seam deflector 79 and label guide 78 to move down into the sewing area. The controller then advances to step 213 where its checks whether the garment body shoulder seam has been detected by the seam detector means. If no seam is detected, the system returns to step 207 to continue counting stitches. In a preferred embodiment, the value of $n_s$ is reduced by a predetermined value to allow the seam deflector time to advance into the sewing area and to create a "window" of time for seam detection. Once the seam is detected, the controller advances to step 215 where the it deactivates the seam detector and it commands the seam deflector to raise up from the sewing area. The controller then advances to step 217 where, after a predetermined number of stitches based on desired seam overlap, it commands the display inserter 64 to move the display feeder 65 into the sewing area as described above. The friction interference between the collarette 22 and display 24 causes the display to be drawn under presser foot 80 to be sewn to the collarette 22 and the garment body 20. The controller then advances to step 219.

At step 219, the controller determines the number of stitches to count to the center of label ($n_{cl}$). In a preferred embodiment, the number of stitches to the center of label is equal to the total number of stitches counted from the start of the sewing operation to seam detection ($N_1$) multiplied by the preferred ratio factor ($n_{cl}=N_1 \times R$). The controller then advances to step 221 where it determines the number of stitches to count from seam detection to start of label feeding ($n_{sl}$). In a preferred embodiment, the number of stitches to count for the start of label is equal to the number of stitches to the center of label less one-half the label width in stitch counts ($n_{sl}=n_{cl}-n_{wl} \times 0.5$). The controller then advances to step 223 where it maintains a second total stitch count ($N_2$) which represents the total number of stitches sewn from seam detection.

The controller then advances to step 225 where it checks whether the total number of stitches counted from seam detection ($N_2$) is greater than or equal to the predetermined number of stitches to count to the start of label feeding ($N_2 \geqq n_{sl}$). If false, the controller returns to step 223 to continue counting stitches. If true, the controller advances to step 227 where it commands the label feeder 70 to feed a label. At this time, the label feed arm 72 brings a pre-cut label 26 into the sewing area and positions same on top of the display 24 and under the presser foot 40. After the label has been almost completely sewn, the label grippers 74 open up to release the label and the label arm 72 continues moving in synchronization with the sewing so as not to disturb completion of the label sewing cycle. Once the label is sewn, the system advances to step 229 where the label guide is raised and label arm 72 returns to its vertical position to grab another label 26 with grippers 74 from hot wire knife 76. Label arm 72 then moves down to a position just above sewing head 40 to await the next label insertion command from controller 36.

The controller than advances to step 231 where it checks whether the end of the garment has been detected by the garment detector 82. If false, sewing continues. If true, the controller advances to step 232 where, after a predetermine number of stitches, the controller commands the display feed means to end feeding display material from the sewing area. The controller then advances to step 235 where the controller maintains a third total stitch count ($N_3$). The controller then advances to step 237 where it checks whether the third total stitch count equals the garment spacing stitch count ($N_3=n_{gs}$). If false, the controller returns to step 235 to continue counting stitches. If true, the controller advances to step 239 where thepresser foot 80 is raised, and if the garment detector still detects no other garment body, sewing head 40 is turned off and sewing is completed.

The varying of the predetermined stitch count after sensing the end of the garment ($n_{gs}$) controlls the spacing between garments. It has been found that a close spacing saves expensive collarette material and increases garment output.

As will become readily apparent to those skilled in the art, the display feeder and label feeder can be deactivated to vary the finished product. For example, the label feeder 70 can be deactivated to that when the apparatus is operated, only a collarette and display will be sewn to the garment body. Similarly, the display feeder can be deactivated such that only a collarette and label will be sewn to the garment body.

Additionally, as will become apparent to those skilled in the art, the synchronization of inserting the display and label need not be dependant on stitch count. For example, timed synchronization can be used to command the display feeder and label feeder at the appropriate times.

Furthermore, as will become readily apparent to those skilled in the art, a second sewing operation on the garment can be performed to sew the loose end of the display down over the overedge seam 32 with a top stitch 33.

Although illustrative preferred embodiments have thus been described herein in detail, it should be noted and will be appreciated by those skilled in the art that numerous variations may be made within the scope of this invention without departing from the principle of the invention and without sacrificing its advantages. The terms and expressions have been used as terms of description and not terms of limitation. There is no intention to use the terms or expressions to exclude any equivalents of features shown and described or portions thereof and the invention should be interpreted in accordance with the claims which follow.

We claim:

1. An apparatus for sewing a collarette, a display, and a label having a width, to a garment body having a leading edge, a trailing edge, and a shoulder seam comprising:

a sewing machine having a sewing head;

a collarette feeder for feeding collarette material under said sewing head so that said collarette material may be sewn to said garment body;

a display feeder for feeding display material under said sewing head on command upon detection of said shoulder seam so that said display material may be sewn to said garment body and said collarette material;

a label feeder including means for severing said label from a continuous supply for feeding said label under said sewing head on command so that said label may be sewn to said garment body, said collarette material, and said display material; and a controller for commanding said display feeder and said label feeder, wherein said collarette material, display material and label are sewn to said garment body as said garment body is transported beneath said sewing head.

2. An apparatus according to claim 1 further comprising a seam detector for detecting said shoulder seam;

said controller commanding said display feeder when said seam detector detects said shoulder seam; and said controller commanding said label feeder when the total number of stitches counted equals a predetermined value.

3. An apparatus according to claim 2 wherein said predetermined value equals the total number of stitches from the start of a sewing operation to seam detection multiplied by a ratio factor less one half said label width in stitch counts.

4. An apparatus according to claim 3 wherein said ratio factor equals one half a distance from said shoulder seam to said trailing edge divided by a distance from said leading edge to said shoulder seam.

5. An apparatus for sewing a label to a garment body comprising:

a sewing machine having a sewing head driven by a motor with a cycle of movement;

a label feed means having a cycle of movement for feeding said label under said sewing head; and controller means for synchronizing the cycle of movement of the label feed means with the cycle of movement of the motor in the sewing head, said controller means controlling said label feed means to feed said label beneath said sewing head at the same speed that said garment body is transported beneath said sewing head so that said label may be accurately sewn to said garment body as said garment body is transported beneath said sewing head.

6. An apparatus for sewing a collarette and a display to a garment body having an operator defined detection location comprising:

a sewing machine having a sewing head;

a collarette feed means for feeding collarette material under said sewing head so that said collarette material may be sewn to said garment body while said garment body is transported beneath said sewing head;

a display feed means for feeding display material under said sewing head upon the detection of said operator defined detection location on said garment body so that said display material may be sewn to said garment body and said collarette material while said garment body is transported beneath said sewing head; and said collarette feed means and said display feed means feeding material under said garment body so as to allow an operator a clear view of said sewing head.

7. A method for sewing a collarette and a display to a garment body having a shoulder seam comprising the steps of:

loading said garment body under a sewing machine sewing head;

feeding collarette material under said sewing head so that said collarette material may be sewn to said garment body as said garment body is transported beneath said sewing head;

detecting said shoulder seam with a seam detector; and commanding said display feed means to feed display material under said sewing head after said seam detector detects said shoulder seam and a predetermined numbers of stitches is formed subsequent to the detection so that said display material may be sewn to said garment body and said collarette material as said garment body is transported beneath said sewing head.

8. A method for sewing a collarette and a label having a width to a garment body having a leading edge, a trailing edge, and a shoulder seam comprising the steps of:

loading said garment body under a sewing machine sewing head;

feeding collarette material under said sewing head so that said collarette material may be sewn to said garment body while said garment body is transported beneath said sewing head; and feeding said label under said sewing head on command after detection of said shoulder seam and a predetermined number of stitches is formed subsequent to the detection so that said label may be sewn to said garment body and said collarette material while said garment body is transported beneath said sewing head.

9. A method according to claim 8 further comprising the steps of counting the total number of stitches performed by said sewing machine; and commanding said label feed means when the total number of stitches counted equals a predetermined value.

10. A method according to claim 8 further comprising the steps of counting the total elapsed time since commencement of a sewing operation; and commanding said label feed means when the total elapsed time equals a predetermined value.

11. A method for sewing a collarette, a display, and a label having a width, to a garment body having a leading edge, a trailing edge, and shoulder seam comprising the steps of:

loading said garment body under a sewing machine head;

feeding collarette material under said sewing head so that said collarette material may be sewn to said garment body while said garment body is transported beneath said sewing head;

counting the total of number of stitches performed by said sewing machine;

detecting said shoulder seam;

feeding display material under said sewing head on command after detecting said shoulder seam;

commanding label feeding when the total number of stitches counted equals a predetermined value, said predetermined value equalling the total number of stitches from the start of a sewing operation to seam detection multiplied by a ratio factor less one-half said label width in stitch counts;

severing said label from a continuous supply; and feeding said label under said sewing head on command so that said label may be sewn to said garment body, said collarette material and said display material while said garment body is transported beneath said sewing head.

12. A method according to claim 11 wherein said ratio factor equals one-half a distance from said shoulder seam to said trailing edge divided by a distance from said leading edge to said shoulder seam.

13. A method for sewing a label to a garment body comprising the step of:

synchronizing the cycle of movement of a label feeder with the cycle of movement of a motor driving the sewing head of a sewing machine to feed said label under said sewing head at the same speed that said garment body is transported beneath said sewing head so that said label may be accurately sewn to said garment body as said garment body is transported beneath said sewing head.

14. A method for sewing a collarette and a display to a garment body having a seam detection location comprising the steps of:

feeding collarette material under said sewing head and under said garment body so as to allow an operator a clear view of said sewing head so that said collarette material may be sewn to said garment body; and feeding display material under said sewing head and under said garment body after detection of said seam detection location and a predetermined number of stitches is formed subsequent to the detection so as to allow an operator a clear view of said sewing head so that said display material may be sewn to said garment body and said collarette material as said garment body is transported beneath said sewing head.

* * * * *